US007472524B2

(12) United States Patent
Hoffman et al.

(10) Patent No.: US 7,472,524 B2
(45) Date of Patent: Jan. 6, 2009

(54) METHOD FOR THE APPLICATION OF PRESSURE RELIEF VALVES

(75) Inventors: Karl K. Hoffman, Arlington Heights, IL (US); Vladimir Prive, Barrington, IL (US); Tom Roberts, Bolingbrook, IL (US); Steve Kaganovich, Northbrook, IL (US)

(73) Assignee: Plitek, L.L.C., Des Plaines, IL (US)

( * ) Notice: Subject to any disclaimer, the term of this patent is extended or adjusted under 35 U.S.C. 154(b) by 0 days.

(21) Appl. No.: 12/002,185

(22) Filed: Dec. 14, 2007

(65) Prior Publication Data

US 2008/0172985 A1 Jul. 24, 2008

Related U.S. Application Data

(62) Division of application No. 11/435,525, filed on May 17, 2006, now Pat. No. 7,328,543.

(51) Int. Cl.
*B65B 61/00* (2006.01)
*B31B 1/84* (2006.01)
*B65C 9/42* (2006.01)

(52) U.S. Cl. ..... 53/410; 53/128.1; 493/213; 493/87; 493/923; 156/361

(58) Field of Classification Search ..... 53/410, 53/505, 128.1, 133.2, 393; 493/8, 923, 213, 493/87; 383/100, 101, 102, 103; 220/367.1, 220/371, 372; 156/353, 361, 362
See application file for complete search history.

(56) References Cited

U.S. PATENT DOCUMENTS 4,270,968 A * 6/1981 Dudzik et al. ..... 156/361
4,290,253 A * 9/1981 Domke et al. ..... 53/410
4,690,667 A * 9/1987 Domke ..... 493/213
5,178,023 A * 1/1993 Domke et al. ..... 73/865.9
5,277,741 A * 1/1994 Kramer ..... 156/353
5,445,870 A * 8/1995 Buchner et al. ..... 428/214
5,727,881 A * 3/1998 Domke ..... 383/103
5,927,336 A * 7/1999 Tanaka et al. ..... 137/843
5,992,635 A * 11/1999 Walters ..... 206/524.8
7,328,543 B2 * 2/2008 Hoffman et al. ..... 53/128.1

OTHER PUBLICATIONS

Accraply Model 230 PRV Pressure Relief Valve Applicator brochure 2 sheets (unnumbered) and pp. 14-16 of manual.

SMC Catalog pp. 229-231 (also Nos. 210-212) for series 11-MSQ Rotary Table/Rack Pinion Type.

* cited by examiner

*Primary Examiner*—Paul R Durand
(74) *Attorney, Agent, or Firm*—John S. Pacocha

(57) ABSTRACT

A method for applying pressure relief valves to packaging during the packaging process. A punch shaft and an applicator shaft each have an axis and opposed ends. The punch shaft has a punch at one end. The applicator shaft has an applicator vacuum head at one end. Each shaft moves axially between retracted and extended positions. The shafts are angled, with the punch and applicator ends more apart than the respective opposed ends, and are carried on a plate for limited rotational movement relative to the applicator unit. First the punch is pivoted from a first position into a third position, while the applicator head is simultaneously pivoted from a second position into the first position. Then the punch is pivoted from the third position back into the first position, and the applicator head is simultaneously pivoted from the first position back into the second position.

3 Claims, 2 Drawing Sheets

METHOD FOR THE APPLICATION OF PRESSURE RELIEF VALVES

This Application is a division of application Ser. No. 11/435,525 filed May 17, 2006 now U.S. Pat. No. 7,328,543.

BACKGROUND OF THE INVENTION

1. Field of the Invention

This invention relates generally to the application of pressure relief valves to packaging for products such as coffee, and an improved apparatus and method for the application of such pressure relief valves.

2. Background Art

Pressure relief valves, such as the PLITEK PLI-VALV PV-28 pressure relief valves, are applied to packaging for products, such as coffee. These valves, which may be plastic or foil, are self-adhering, thin, low profile designs supplied on a non-tearing polyester liner. The valves have an adhesive on the back side which adheres them to the liner, until the valves are removed immediately prior to the application to the packaging, and then provides for affixing the valves to the packaging. An example of the technical properties of such valves is an opening pressure differential to pressure of 0.1375 psig (9.5 milibars) and valve closure occurs after pressure drops to 0.0375 psig (2.6 milibars). The valves vent unwanted gases and seal out atmospheric gases from rigid or flexible packaging. One advantage of such valves is that they allow coffee to be packed immediately after roasting and grinding to preserve freshness. Elimination of the holding required to allow products such as coffee to degas saves time and money, while ensuring that customers receive the highest quality coffee.

Such pressure relief valves are usually applied during the packaging process, more particularly, after the containers are formed and are being filled with the product. The packaging process may permit intermittent application of the valves, or may require that the valves be applied in a continuous operation. A system for the application of the valves generally includes a base unit, a set of guide rollers, electronic and pneumatic components, a valve oiling unit, and a valve applicator unit. The base unit provides for advancing and indexing a liner strip carrying the pressure relief valves. Conveniently, the base unit may comprise an unwinder, a rewinder (for the empty liner after the valves have been applied to the packaging), electrical components, pneumatic components, control components, and a drive motor. Guide rollers are used to orient the running direction of the liner (generally vertical or horizontal), as needed to accommodate the packaging equipment in conjunction with which the pressure relief valve applying system is being used. Electronic equipment may include sensors and stepper motors, and the pneumatic components generally include a vacuum generator, regulators and filters for feeding the vacuum and pneumatic systems, as well as valves for operating pneumatic cylinders. An oil applicator, generally positioned proximate but prior to the valve applicator unit, provides oil to activate the pressure relief valve before it is applied to the packaging. The valve applicator unit conveniently comprises a punch, piercing needle, or some other device to make an opening in the packaging, a peeler bar assisting in the removal of the pressure relief valve from the liner, and a valve applicator head for attaching the pressure relief valve to the packaging in operating register with the opening made by the punch, needle or other device. An example of such a prior art device is the ACCRAPLY Model 230 PRV Pressure Relief Valve Applicator.

A problem encountered in the prior art application of pressure relief valves to packaging, due in part to the many variables and tolerances in the processes of forming and filling the packaging, is the misalignment of the pressure relief valve with the opening with which the valve needs to be in operating register. Accordingly, there remains a need for a system with a pressure relief valve applicator for packaging in which the accuracy of the placement of the valve over, and in operating register with, the opening in the packaging is improved with respect to prior art devices.

SUMMARY OF THE INVENTION

The present invention is concerned with providing a system for applying a pressure relief valve to packaging during the packaging process, including a valve applicator unit having a punch shaft with an axis and opposed ends and an applicator shaft with an axis and opposed ends. A punch is mounted at one, punch end of the punch shaft. An applicator vacuum head is mounted at one, applicator end of the applicator shaft. The punch shaft is carried by the valve applicator unit for movement along the axis of the punch shaft between a punch retracted position and a punch extended position. The applicator shaft is carried by the valve applicator unit for movement along the axis of the applicator shaft between an applicator vacuum head retracted position and an applicator vacuum head extended position. The punch shaft and the applicator shaft are also carried with their respective axes at an angle to each other by the valve applicator unit, such that the punch end and the applicator end are spaced further apart than are the respective opposed ends of each of the shafts.

The valve applicator unit also includes a plate carrying the punch shaft and the applicator shaft. The plate is mounted for rotational movement relative to the valve applicator unit such that the punch is pivoted from a first position into a third position and the applicator vacuum head is simultaneously pivoted from a second position into the first position. In addition, the plate carrying the punch shaft and the applicator shaft is also mounted for rotational movement relative to the valve applicator unit such that the punch is pivoted from the third position back into the first position, and the applicator vacuum head is simultaneously pivoted from the first position back into the second position.

BRIEF DESCRIPTION OF THE DRAWINGS

For a better understanding of the present invention, reference may be had to the accompanying drawings in which.

DETAILED DESCRIPTION

Figure 1:
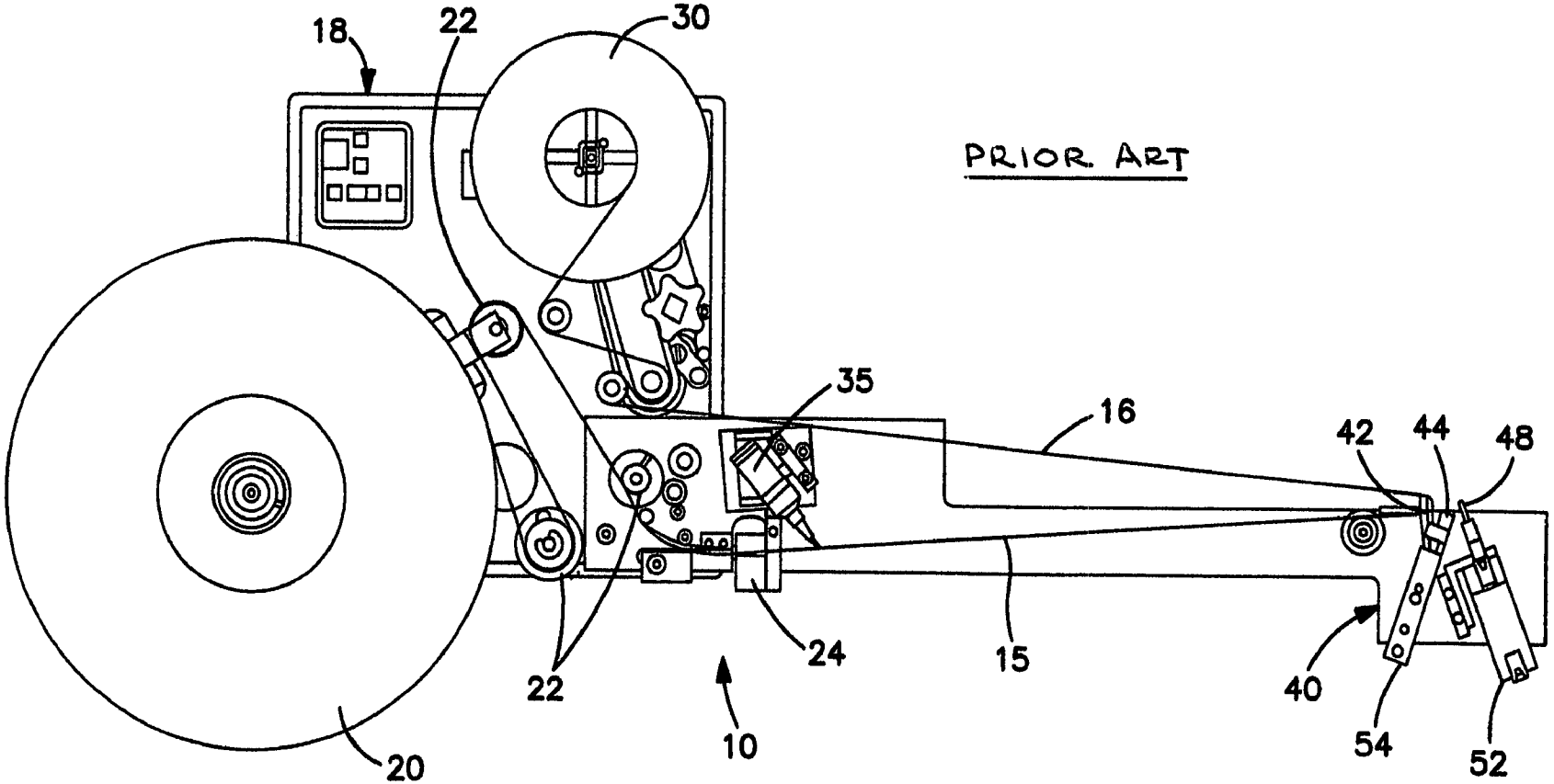
FIG. 1 is a schematic view of a prior art pressure relief valve applicator system, including a base unit, a valve oiling unit, and an applicator unit.

The present invention relates to the field of applying pressure relief valves to product packaging. To generally illustrate a system for applying pressure relief valves, and a prior art pressure relief valve applicator unit, there is schematically shown in FIG. 1 a prior art ACCRAPLY Model 230 PRV Pressure Relief Valve Applicator. The illustrated system 10 is designed to be attached to an intermittent vertical form fill and seal packaging machine (not shown) for the application of pressure relief valves such as the PLITEK PLI-VALV PV-28 pressure relief valves. While the pressure relief valves themselves are not shown in detail, there is illustrated in FIG. 1, a liner 15 carrying pressure relief valves for removal and application to the packaging and, after the valves have been applied, an empty liner 16. A base unit 18, on which an unwinder 20 containing a roll of the pressure relief valve carrying liner 15 is mounted, provides for unwinding liner 15, passing it around guide and tensioning rollers 22 and through a sensor 24, which detects the beginning and end of each valve and controls the dispensing of the valves in combination with controls for the packaging line. Base unit 18 also includes a rewinder 30 for taking up the empty liner 16 after the valves have been applied to the packaging.

An oil applicator 35, which may comprise an EFD 752V Series Diaphragm Valve, applies oil to the pressure relief valve after liner 15 passes through sensor 24 and before the pressure relief valve is removed from the liner for application to the packaging. Liner 15, carrying the oiled pressure relief valve, then proceeds to the valve applicator unit 40 where the valve is removed from the liner with the assistance of a dispenser or peeler 42 and is held on a tamp applicator head 44 by vacuum. Liner 16, no longer carrying the pressure relief valves, is then returned to the rewinder 30.

Valve applicator unit 40 also comprises a punch or piercing needle 48, and pneumatic cylinders 52 and 54 for selectively advancing punch 48 and tamp applicator head 44, respectively. Punch 48 and applicator head 44 are each mounted for reciprocating movement by their respective pneumatic cylinders, along a respective angled axis, so as to converge at a point of application of a pressure relief valve to packaging. Thus, it is intended to first advance punch 48 by its pneumatic cylinder 52 towards a specific point to make an opening in the packaging, and then to advance tamp applicator 44 by its pneumatic cylinder 54 to apply the pressure relief valve to the packaging in operating register with the opening made by punch 48. However, as previously indicated, there are many variables and tolerances in the processes of forming and filling the packaging, and misalignment of the pressure relief valve with the opening can occur at a greater rate than is desirable with such an applicator unit.

Figure 2:
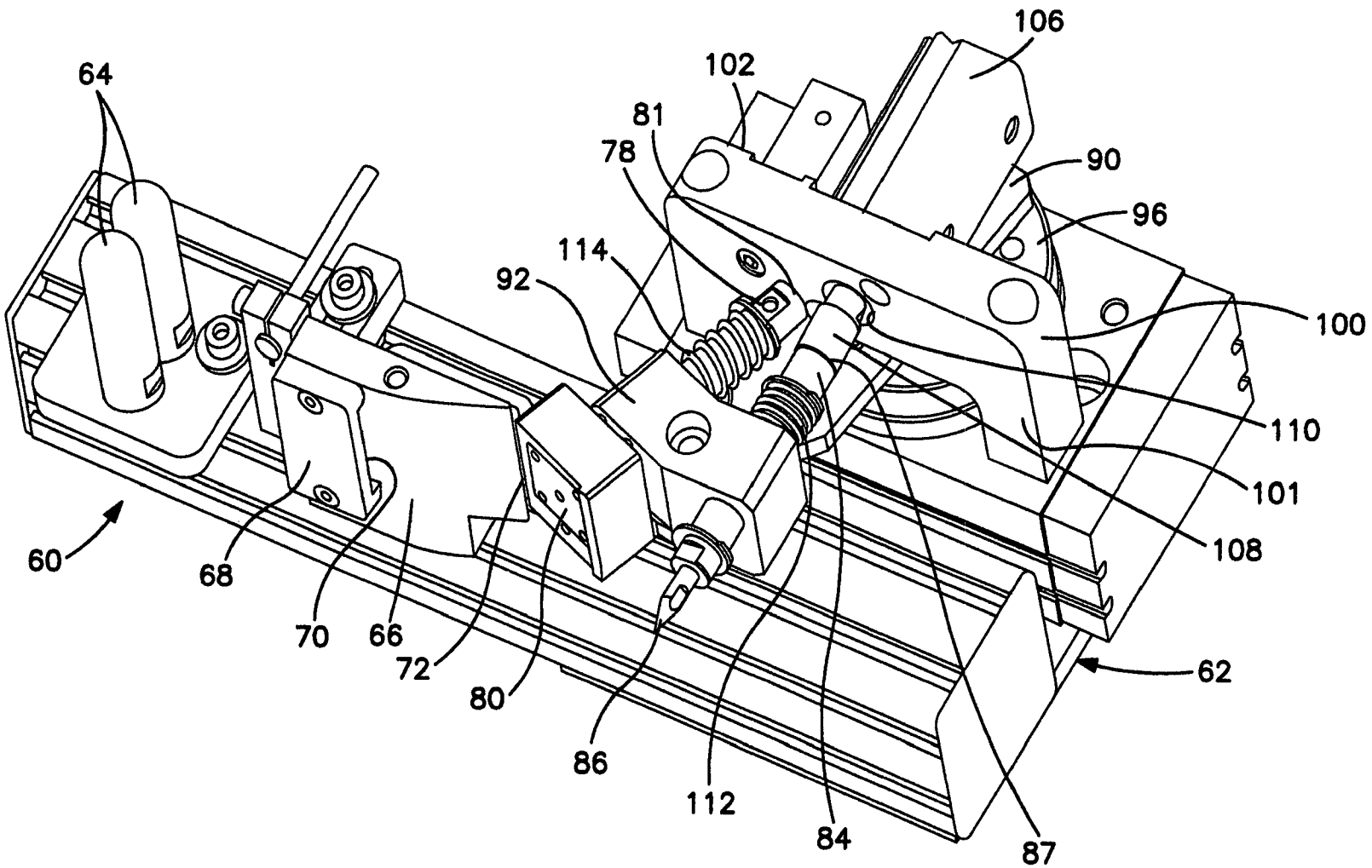
FIG. 2 is perspective view of an embodiment of a pressure relief valve applicator unit of the present invention.

FIG. 2 shows an improved pressure relief valve applicator unit 60 embodying the present invention. Applicator unit 60 may be used in a system such as that illustrated in FIG. 1, as a replacement for applicator unit 40. Alternatively, applicator unit 60 may be used in other systems comprising other versions or modifications of the basic components of a base unit, an unwinder, a rewinder, a drive motor, a set of guide rollers, electronic components, a vacuum generator, pneumatic components, and a valve oiling unit, generally similar to those that have been shown and described, or other versions of them.

Valve applicator unit 60, as shown in FIG. 2, includes a base 62. At one end of base 62, on the downstream side of the oil applicator of the system, is a pair of spaced apart, vertically oriented, rollers 64 for guiding the liner with the oiled pressure relief valves. Further downstream is a peeler bar 66, which includes a liner leader 68 with a recess 70. The liner with the oiled pressure relief valves passes between peeler bar 66 and liner leader 68, through recess 70, and passes over edge 72 of peeler bar 66 to facilitate the removal of the adhesive backed pressure relief valve from the liner. After the valve is removed from the liner, the empty liner is taken up on a rewinder as previously described.

A valve applicator shaft 78 has a valve applicator vacuum head 80 at one end. Head 80, under operation of a vacuum, releaseably carries the peeled pressure relief valve which has just passed over edge 72. A vacuum, provided by the vacuum generator of the system, is conveniently selectively applied through vacuum lines to head 80 to carry and releaseably retain the pressure relief valve. A system mat rely on the adherence of the valve to the packaging to overcome the vacuum and release the valve from head 80; alternatively, operation of the vacuum mat be synchronized to be shut off, by a conventional solenoid control, at the time that the valve is being applied to the packaging. Shaft 78 is carried by valve applicator unit 60 for axial movement between a retracted position and an extended position. Valve applicator unit 60 also has a punch shaft 84 with a punch or piercing needle 86 at one end. Punch shaft 84 is also carried for axial movement between a retracted position and an extended position.

Applicator shaft 78 and punch shaft 84 are, as shown in FIG. 2, carried by unit 60, or more particularly by a plate 90, with their respective axes at an angle to each other, such that punch 86 and head 80 are further apart than are the respective opposed ends of the shafts. A yoke 92 secures punch shaft 84 and applicator shaft 78 apart at a fixed distance proximate the punch end of the punch shaft and the applicator end of the applicator shaft.

Plate 90 is carried for rotational movement relative to unit 60. More particularly, plate 90 is connected to a pneumatic rotary table 96, such as a SMC Series 11-MSQ Rotary Table, mounted on unit 60. Rotary table 96 may be adjusted to limit the angle of both clockwise and counterclockwise rotation to define a preset pivotal arc of movement. Thus, plate 90 may be selectively rotated or pivoted through a defined, counterclockwise with respect to FIG. 2, arc in which punch 86 is pivoted from with a first position generally aligned with where the pressure relief valve is to be placed on a package into a third position at the same time applicator vacuum head 80 is simultaneously pivoted from a second position into the first position in register with the opening pierced in the package by punch 86. Reverse, or clockwise, rotation of table 96 and plate 90 will then pivot punch 86 from the third position back into the first position, and applicator vacuum head 80 is simultaneously pivoted from the first position back into the second position. Internal, preset stops within rotary table 96 limit the arc of pivotal movement. A bridge 100 also provides mechanical, back-up stops for the pivotal movement of plate 90.

A bridge 100, with opposed faces 101 and 102, spans plate 90 proximate the opposed ends of punch shaft 84 and applicator shaft 78. Adjacent face 102 of bridge 100, unit 60 carries a pneumatic cylinder 106 with a driven shaft 108. Pneumatic cylinder 106 provides a single driver for direct or indirect, selective engagement with either opposed end 87 of punch shaft 84 to drive the punch shaft to the punch extended position shown in FIG. 2, or opposed end 81 of applicator shaft 78 to drive the applicator shaft to an applicator vacuum head extended position. Driven shaft 108 of pneumatic cylinder 106 extends through an opening 110 in bridge 100 to selectively engage end 87 or end 81.

Each of punch shaft 84 and applicator shaft 78 are provided with a return spring 112 and 114, respectively. When driven shaft 108 engages punch shaft 84, it is moved axially to its extended position as shown in FIG. 2, and spring 112 is compressed, again as is shown is FIG. 2. When driven shaft 108 is retracted, and punch shaft 84 is pivoted out of register with the first position, spring 112 will move punch shaft 84 back to a retracted position. Applicator shaft 78 and spring 114 operate in a similar manner with respect to driven shaft 108 when applicator shaft is pivoted into register with the first position.

Upon setting up valve applicator 60, punch or piercing needle 86 needs to be adjusted in accordance with the package requirements. In operation, system sensors that detect the presence of, for example, a filled package of coffee, emit a signal that starts the cycle of application. Punch or piercing needle 86 starts working to make the required opening in the package and applicator vacuum head 80 picks up the oiled pressure relief valve that has just been peeled from the liner. Plate 90 is then pivoted, moving punch 86 out of register with the package and driven shaft 108 of pneumatic cylinder 106, and pivoting applicator vacuum head into the exact same position from which punch 86 has been removed. At that time driven shaft 108 engages applicator shaft 78, and the vacuum may be removed from head 80, to apply the pressure relief valve in operating register with the opening that has just been made by punch 86. Rotary table 102 then returns plate 90, punch shaft 84 and applicator shaft 78 back to their respective initial positions, and the cycle repeats. Thus, while punch 86 is pivoted from a first position, in register with where the pressure relief valve is to be applied to the packaging, into a third position, away from the packaging, and the applicator vacuum head 80 is simultaneously pivoted from a second position, for receiving the pressure relief valve to be applied to the packaging, into the first position, in register with where the pressure relief valve is to be applied to the packaging, plate 90 itself has limited rotational movement relative to the valve applicator unit between only two positions, a piercing position and a valve applying position.

Solely as an example, the present invention has been discussed in the context of coffee packaging although it can be readily used for the packing of other food and non-comestible products. While a particular embodiment of the invention has been shown and described, alternatives, variations and modifications will occur to those skilled in the art. It is intended in the appended claims to cover all such alternatives, variations and modifications that come within the true spirit and scope of the present invention.

What is claimed as new and desired to be secured by Letters Patent is:

1. A method for applying a pressure relief valve to packaging during the packaging process comprising the steps of:

peeling a pressure relief valve from a liner of pressure relief valves;

piercing a package with a punch in a first pivotal position, in register with where the pressure relief valve is to be applied to the packaging, to make an opening in a package;

picking the peeled pressure relief valve with an applicator vacuum head with an operating vacuum in a second pivotal position, for receiving the pressure relief valve to be applied to the packaging, while the punch is in the first pivotal position;

pivoting the punch from the first pivotal position and into a third pivotal position, away from the packaging, and simultaneously pivoting the applicator vacuum head from the second pivotal position into the first pivotal position, in register with where the pressure relief valve is to be applied to the packaging; and putting the pressure relief valve on the package over, and in register with, the opening pierced in the package when the applicator vacuum head is in the first pivotal position.

2. The method of claim 1 for applying a pressure relief valve to packaging during the packaging process additionally comprising the step of rotating a plate carrying the punch and the applicator vacuum head between only two positions, a piercing position and a valve applying position.

3. The method of claim 1 for applying a pressure relief valve to packaging during the packaging process further comprising the step of releasing the vacuum of the applicator vacuum during the step of putting the pressure relief valve on the package.

* * * * *